US008487839B2

(12) United States Patent
Chung et al.

(10) Patent No.: US 8,487,839 B2
(45) Date of Patent: Jul. 16, 2013

(54) PLASMA DISPLAY PANEL AND METHOD OF MANUFACTURING THE SAME

(75) Inventors: Woo-Joon Chung, Yongin-si (KR); Tae-Seong Kim, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 211 days.

(21) Appl. No.: 12/868,639

(22) Filed: Aug. 25, 2010

(65) Prior Publication Data

US 2011/0115692 A1 May 19, 2011

(30) Foreign Application Priority Data

Nov. 13, 2009 (KR) ..... 10-2009-0109705

(51) Int. Cl.
*G09G 3/28* (2006.01)
*H01J 9/24* (2006.01)

(52) U.S. Cl.
USPC ..... 345/60; 445/24

(58) Field of Classification Search
USPC ..... 345/60, 37; 445/24; 313/231.31
See application file for complete search history.

(56) References Cited

U.S. PATENT DOCUMENTS

| | | | | |
|---|---|---|---|---|
| 6,262,699 | B1 * | 7/2001 | Suzuki et al. | 345/68 |
| 2002/0126069 | A1 * | 9/2002 | Kim et al. | 345/60 |
| 2004/0169621 | A9 * | 9/2004 | Lee et al. | 345/60 |
| 2010/0128013 | A1 * | 5/2010 | Soh et al. | 345/211 |

FOREIGN PATENT DOCUMENTS

| | | |
|---|---|---|
| JP | 2007-219502 | 8/2007 |
| KR | 10-2004-0092556 | 11/2004 |
| KR | 10-2005-0041049 | 5/2005 |
| KR | 10-2006-0014981 | 2/2006 |
| KR | 10-2008-0046494 | 5/2008 |

OTHER PUBLICATIONS

KIPO Office Action dated Apr. 7, 2011 for Korean priority patent application 10-2009-0109705, noting the listed references in the IDS.

* cited by examiner

*Primary Examiner* — Kent Chang
*Assistant Examiner* — Scott Au
(74) *Attorney, Agent, or Firm* — Christie, Parker & Hale, LLP

(57) ABSTRACT

A plasma display panel (PDP) and a method of manufacturing the same, the PDP including scan electrodes extending parallel to one another, sustain electrodes extending parallel to the scan electrodes, and address electrodes extending across the sustain electrodes and the scan electrodes. The address electrodes are divided into a first address electrode group extending from a first side of the panel, and a second address electrode group extending from an opposing second side of the panel, such that the first and second groups are disposed on different sides of the PDP.

8 Claims, 4 Drawing Sheets

PLASMA DISPLAY PANEL AND METHOD OF MANUFACTURING THE SAME

CROSS-REFERENCE TO RELATED APPLICATION

This application claims the benefit of Korean Patent Application No. 10-2009-0109705, filed on Nov. 13, 2009, in the Korean Intellectual Property Office, the disclosure of which is incorporated herein, by reference.

BACKGROUND

1. Field

One or more exemplary embodiments of the present disclosure relate to a plasma display panel (PDP) and a method of manufacturing the same.

2. Description of the Related Art

Plasma display panels (PDPs) are devices that form an image by generating an electric discharge between scan electrodes and sustain electrodes. In general, PDPs have a rectangular shape and the scan electrodes and sustain electrodes are arranged in a horizontal direction of the rectangular shape and extend parallel to each other. Address electrodes intersect the scan electrodes and the sustain electrodes and extend in a vertical direction of the rectangular shape.

FIG. 1 illustrates electrodes of a general PDP. As described above, sustain electrodes X extend horizontally, parallel to one another, from opposing first and second sides of a rectangular panel. Scan electrodes Y1 through Y1080 are also arranged in the horizontal direction. The scan electrodes Y1 through Y1080 are parallel to one another and extend horizontally from the second side to the first side of the rectangular panel. Address electrodes A1 through A1920 intersect the sustain electrodes X and the scan electrodes Y1 through Y1080, and extend in a vertical direction.

As the size of a PDP increases, the length of the scan electrodes, sustain electrodes, and address electrodes increases. Accordingly, when a scan pulse, a sustain pulse, and an address pulse are respectively applied to the scan electrodes, the sustain electrodes, and the address electrodes, a large voltage drop occurs at a central portion of a panel, due to the increased resistance of the longer electrodes. Accordingly, in order to apply a desired voltage between the electrodes, a higher voltage pulse needs to be applied.

SUMMARY

One or more exemplary embodiments of the present disclosure provide a plasma display panel (PDP), which may reduce the magnitude of a voltage applied to electrodes of the PDP, and a method of manufacturing the PDP According to one or more embodiments of the present disclosure, a PDP includes: scan electrodes extending parallel to one another, in a short direction of a panel; sustain electrodes extending parallel to the scan electrodes; and address electrodes intersecting the scan electrodes and the sustain electrodes, and extending in a long direction of the panel. The address electrodes include a first address electrode group extending from a first side of the panel, and a second address electrode group extending from a second side opposing side of the panel, which are separated from the first address electrode group.

According to various embodiments, the scan electrodes may include a first scan electrode group and a second scan electrode group. The sustain electrodes may include a first sustain electrode group and a second sustain electrode group.

The first address electrode group may intersect the first scan electrode group and the first sustain electrode group, and the second address electrode group may intersect the second scan electrode group and the second sustain electrode group.

According to various embodiments, the PDP may further include: a scan driving unit to apply a scan pulse to the first scan electrode group and the second scan electrode group; a sustain driving unit to apply a sustain pulse to the first sustain electrode group and the second sustain electrode group; a first address driving unit to apply an address pulse to the first address electrode group; and a second address driving unit to apply an address pulse to the second address electrode group.

According to various embodiments, the scan driving unit may apply the same scan pulse to a scan electrode pair including one scan electrode included in the first scan electrode group and one scan electrode included in the second scan electrode group.

According to one or more embodiments of the present disclosure, a method of manufacturing a PDP includes: forming scan electrodes that extend parallel to one another in a short direction of a panel; forming sustain electrodes that are parallel to the scan electrodes and extend in a direction opposite to a direction in which the scan electrodes extend; and forming address electrodes that include a first address electrode group and a second address electrode group, which intersect the scan electrodes and the sustain electrodes and extend in a long direction of the panel. The first address electrode group extends from a first side of the panel, in the long direction, and the second address electrode group extends from an opposing second side of the panel, in the long direction, and is separated from the first address electrode group.

According to various embodiments, the scan electrodes may include a first scan electrode group and a second scan electrode group. The sustain electrodes may include a first sustain electrode group and a second sustain electrode group. The first address electrode group may intersect the first scan electrode group and the first sustain electrode group, and the second address electrode group may intersect the second scan electrode group and the second sustain electrode group.

According to various embodiments, the method may further include a scan driving unit to apply a scan pulse to the first scan electrode group and the second scan electrode group, a sustain driving unit to apply a sustain pulse to the first sustain electrode group and the second sustain electrode group, a first address driving unit to apply an address pulse to the first address electrode group, and a second address driving unit to apply an address pulse to the second address electrode group.

According to various embodiments, an output terminal of the scan driving unit may be simultaneously connected to a scan electrode pair including a scan electrode included in the first scan electrode group and a scan electrode included in the second scan electrode group.

Additional aspects and/or advantages of the present disclosure will be set forth in part in the description which follows and, in part, will be obvious from the description, or may be learned by practice of the disclosure.

BRIEF DESCRIPTION OF THE DRAWINGS

These and/or other aspects and advantages of the present disclosure will become apparent and more readily appreciated from the following description of the exemplary embodiments, taken in conjunction with the accompanying drawings, of which.

DETAILED DESCRIPTION

Figure 1:
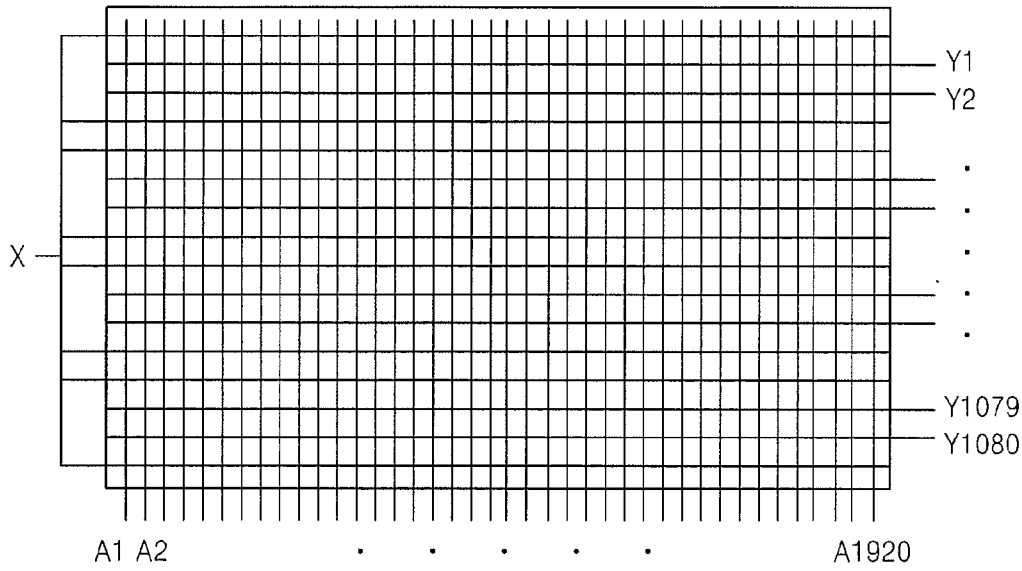
FIG. 1 (RELATED ART)
FIG. 1 illustrates electrodes of a general plasma display panel (PDP)

Reference will now be made in detail to the exemplary embodiments of the present disclosure, examples of which are illustrated in the accompanying drawings, wherein like reference numerals refer to the like elements throughout. The exemplary embodiments are described below, in order to explain the aspects of the present disclosure, by referring to the figures.

Figure 2:
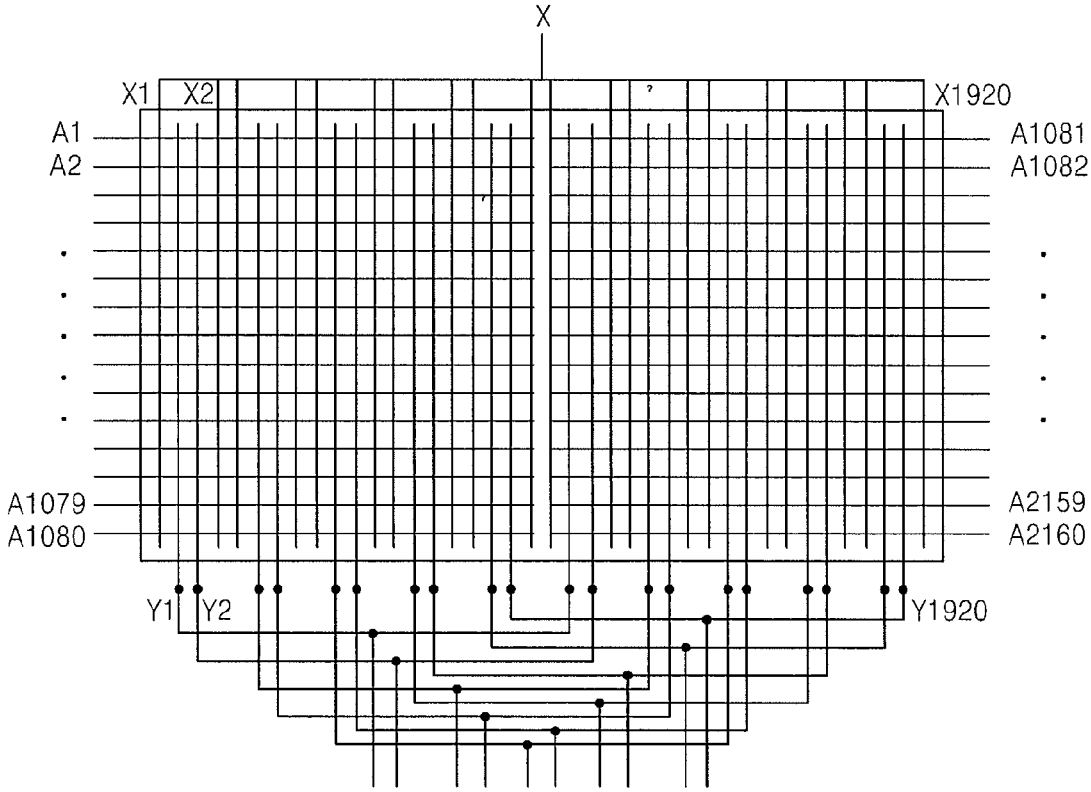
FIG. 2 illustrates electrodes of a PDP, according to an exemplary embodiment of the present disclosure.

FIG. 2 illustrates electrodes of a plasma display panel (PDP), according to an exemplary embodiment of the present disclosure. It is assumed that the PDP has 1920×1080 pixels. However, the present disclosure is not limited to any particular number of pixels.

Referring to FIG. 2, the PDP has a rectangular shape and includes scan electrodes Y1 through Y1920, sustain electrodes X1 through X1920, and address electrodes A1 through A2160. Herein, aspects of the PDP, such as the height, width, bottom, top, left side, and right side, relate to the PDP when viewed from a conventional viewing position. The height (vertical axis) of the PDP may be referred to as a short direction, and the width (horizontal axis) of the PDP may be referred to as a long direction.

The scan electrodes Y1 through Y1920 extend from the bottom to the top of the PDP. That is, the scan electrodes Y1 through Y1920 extend vertically in the PDP. The scan electrodes Y1 through Y1920 are arranged parallel to one another.

The scan electrodes Y1 through Y1920 may be divided into a first scan electrode group including electrodes Y1 through Y960 and a second scan electrode group including electrodes Y961 through Y1920. The first scan electrode group is disposed on the left side of the PDP. The second scan electrode group is disposed on the right side of the PDP. The same scan pulse may be applied to electrodes in both of the scan electrode groups, by connecting each scan electrode in the first scan electrode group to a corresponding electrode in the second scan electrode group. That is, the scan electrodes Y1 through Y1920 may be configured in such a way that the same scan pulse may be applied to each pair of connected scan electrodes. For example, the first scan electrode Y1 may be connected to the 961th scan electrode Y961, the second electrode Y2 may be connected to the 962th scan electrode Y962, and so on, as shown in FIG. 2.

The sustain electrodes X1 through X1920, which are common electrodes, extend from the top to the bottom of the PDP. That is, the sustain electrodes X1 through X1920 may extend vertically, downward from the top of the PDP, such that free ends thereof are disposed adjacent to the bottom of the PDP. The sustain electrodes X1 through X1920 are arranged parallel to one another.

The sustain electrodes X1 through X1920 may be divided into a first sustain electrode group including electrodes X1 through X960 and a second sustain electrode group including electrodes X961 through X1920. The first sustain electrode group is disposed on the left side of the PDP, and the second sustain electrode group is disposed on the right side of the PDP. The same sustain pulse is applied to the sustain electrodes X1 through X1920. Accordingly, the electrodes X1 through X1920 are all electrically connected.

Although the first sustain electrode group and the first scan electrode group are shown as being disposed on the left side of the PDP, and the second sustain electrode group is shown to be disposed on the right side of the PDP, in FIG. 2, the present disclosure is not limited thereto. For example, the positions of the groups may be reversed. In other words, each of the scan electrode groups covers about half of a display area of the PDP.

Although in FIG. 2 the sustain electrodes X1 through X1920 are shown to extend from the top to the bottom of the PDP, and the scan electrodes Y1 through Y1920 extend from the bottom to the top of the PDP, the present embodiment is not limited thereto. For example, the positions of the sustain electrodes X1 through X1920 and the scan electrodes Y1 through Y1920 may be reversed.

The address electrodes A1 through A2160 extend toward the center of the PDP, from either the left or right side of the PDP. That is, the address electrodes A1 through A2160 extend horizontally across the PDP, such that free ends thereof are disposed in the center of a display region of the PDP. The address electrodes A1 through A2160 are parallel to one another.

The address electrodes A1 through A2160 intersect the sustain electrodes X1 through X1920 and the scan electrodes Y1 through Y1920. In detail, the address electrodes A1 through A2160 may be divided into a first address electrode group including electrodes A1 through A1080, and a second address electrode group including electrodes A1081 through A2160. The electrodes A1 through A1080 of the first address electrode group extend from the left side toward the right side of the PDP, and intersect the electrodes X1 through X960 of first sustain electrode group and the electrodes Y1 through Y960 of the first scan electrode group. The electrodes A1081 through A2160 of second address electrode group extend from the right side of the PDP toward the left side of the panel, and intersect the electrodes X961 through X1920 of the second sustain electrode group and the electrodes Y961 through Y1920 of the second scan electrode group. In other words, each of the address electrode groups cover about half of the display area of the PDP. In addition, free ends of the address electrodes are disposed adjacent to a vertical axis that extends through the center of the PDP.

The first address electrode group and the second address electrode group are driven by different driving units. Accordingly, the first address electrode group and the second address electrode group may be separated from each other. That is, the electrodes A1 through A1080 may be separated from the electrodes A1081 through A2160, so that a data signal applied to the first address electrode group is not applied to the second address electrode group and vice versa.

Pixels are formed at intersections of the address electrodes, the sustain electrodes, and the scan electrodes. Since one pixel includes R, G, and B sub-pixels, although not shown in FIG. 2, each of the address electrodes A1 through A2160 may include 3 electrodes.

Figure 3A:
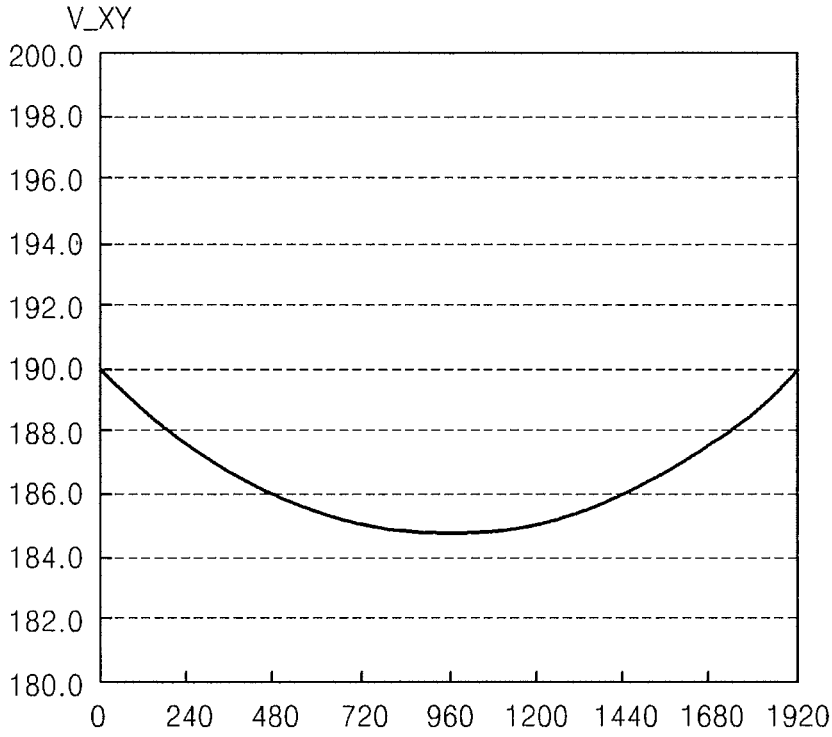
FIG. 3A is a graph illustrating a voltage drop occurring in sustain electrodes and scan electrodes of a general PDP.

FIGS. 3A through 4B illustrate experimental results obtained by applying a voltage to a general PDP and to the PDP of FIG. 2. FIG. 3A is a graph illustrating a voltage drop occurring in sustain electrodes and scan electrodes of a general PDP. FIG. 3B is a graph illustrating a voltage drop occurring in sustain electrodes and scan electrodes, of a PDP according to an exemplary embodiment of the present disclosure. In FIGS. 3A and 3B, the horizontal axis represents positions where a voltage is measured, and the vertical axis represents the magnitude of the voltage. A voltage of 200 V was applied to the general PDP and the PDP according to the present embodiment. Bus resistance was 100Ω, and current was 220/1080 A.

Referring to FIG. 3A, a voltage drop occurred, due to the resistance of the sustain electrodes, and voltages lower than a voltage of 200 V, which was initially applied, were measured. In detail, although a voltage of 200 V was applied to the sustain electrodes, voltages of about 190 V were measured at ends of the general PDP, and a voltage of about 185 V was measured at a central portion of the general PDP. That is, the maximum voltage drop was 15 V, and the voltage distribution was about 5 V, in the general PDP. Accordingly, in order to achieve a voltage difference of 200 V, between the electrodes of the general PDP, a voltage of higher than 200 V should be applied.

Figure 3B:
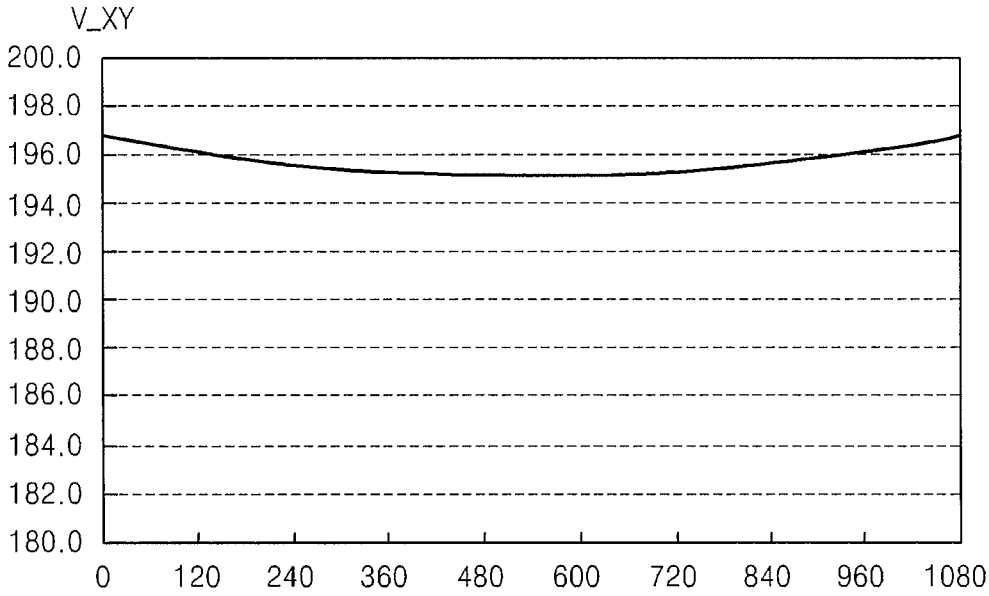
FIG. 3B is a graph illustrating a voltage drop occurring in sustain electrodes and scan electrodes of a PDP, according to an exemplary embodiment of the present disclosure.

Referring to FIG. 3B, since the electrodes of the PDP according to the present embodiment are shorter in length than the electrodes of the general PDP, a voltage drop due to the resistance of the electrodes was reduced. In detail, when a voltage of 200 V was applied to the sustain electrodes, a voltage of about 197 V was measured at both ends of the exemplary PDP, and a voltage of about 195 V was measured at a central portion of the exemplary PDP. That is, the maximum voltage drop was 5 V, and the voltage distribution was between 1.5 to 2 V, which is lower than the voltage distribution of about 5 V of the general PDP.

Accordingly, the voltage drop of the exemplary PDP was about 67% lower than that of the general PDP, and the voltage distribution of the exemplary PDP was about 60 to 70% lower than that of the general PDP. Therefore, as shown in FIGS. 3A and 3B, the exemplary PDP may be stably driven at a lower voltage than that of the general PDP.

Figure 4A:
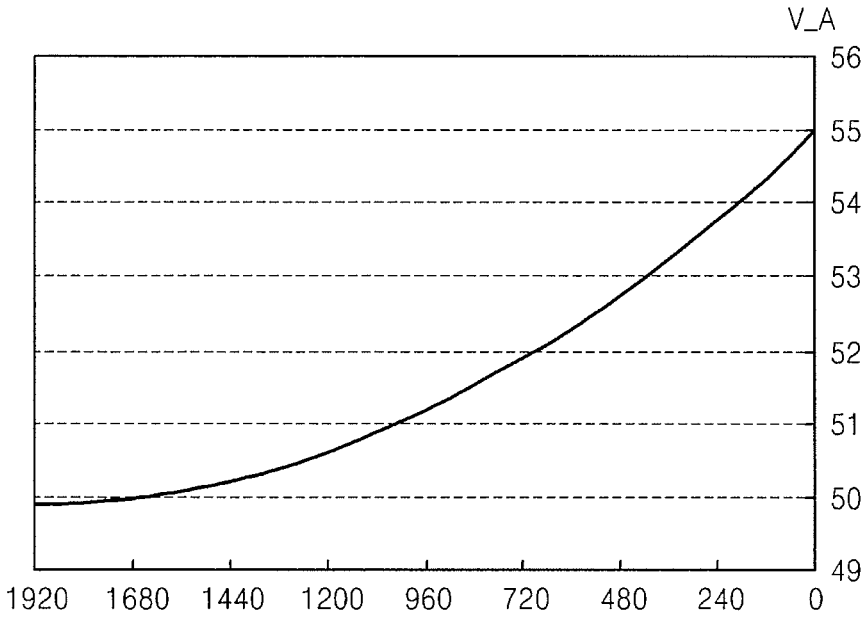
FIG. 4A is a graph illustrating a voltage drop occurring in address electrodes of a general PDP.
Figure 4B:
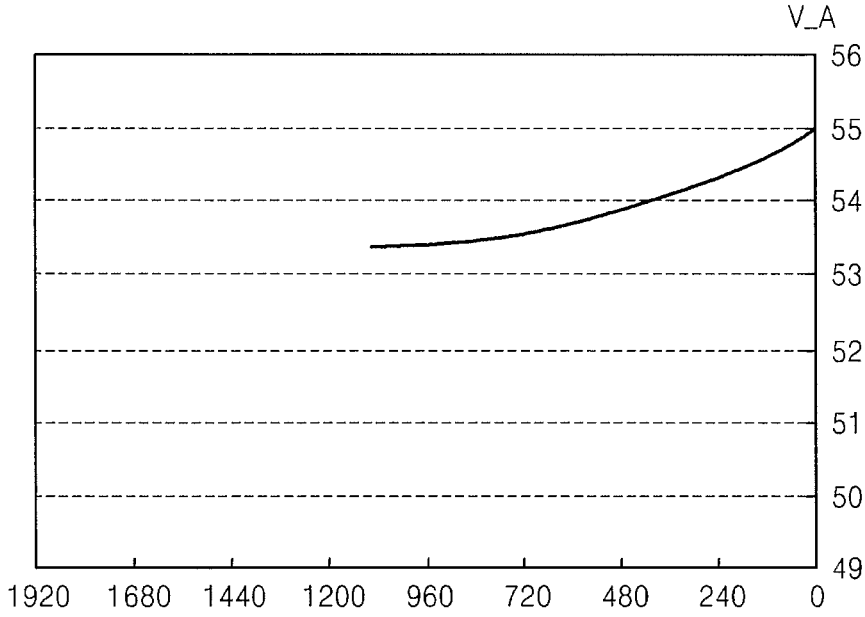
FIG. 4B is a graph illustrating a voltage drop occurring in address electrodes of a PDP, according to an exemplary embodiment of the present disclosure.

FIG. 4A is a graph illustrating a voltage drop occurring in address electrodes of the general PDP. FIG. 4B is a graph illustrating a voltage drop occurring in address electrodes of a PDP according to an exemplary embodiment of the present disclosure. In FIGS. 4A and 4B, the horizontal axis represents positions where a voltage was measured, and the vertical axis represents the magnitude of the voltage. A voltage of 55 V was applied to the address electrodes of the general PDP and the exemplary PDP, the bus resistance was 100Ω, and the current was 110/1920 A.

Referring to FIG. 4A, a voltage drop occurred due to the resistance of the electrodes and a voltage lower than the initial voltage of 50 V was measured. In detail, although the voltage of 55 V was applied to the address electrodes, a voltage of 50 V was measured at ends of the general PDP. That is, the maximum voltage drop was 5 V. Accordingly, in order to achieve a desired gradation of a pixel that is located far away from an address driving unit of the general PDP, a voltage higher than 55 V should be applied.

Referring to FIG. 4B, since the electrodes of the exemplary PDP were shorter in length than the electrodes of the general PDP, a voltage drop due to the resistance of the electrodes was reduced. In detail, when the voltage of 55 V was applied to the address electrodes, a voltage of about 53 V was measured at an end of the exemplary PDP. That is, the maximum voltage drop was 2 V. The voltage drop of the exemplary PDP was about 60% lower than that of the general PDP. Therefore, as shown in FIGS. 4A and 4B, the exemplary PDP may exhibit better gradation at a lower voltage than the general PDP.

Figure 5:
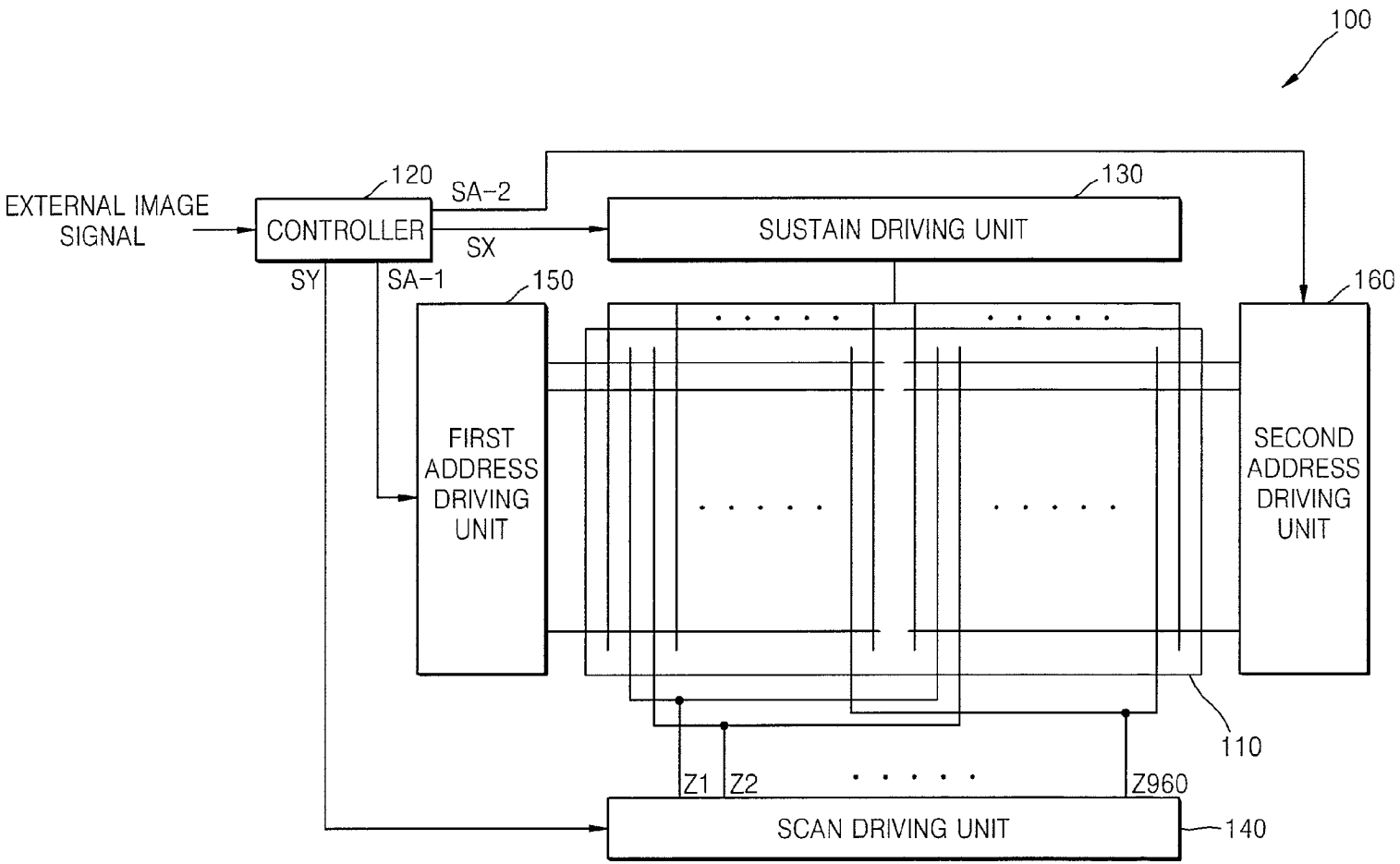
FIG. 5 is a block diagram of a PDP, according to an exemplary embodiment of the present disclosure.

FIG. 5 is a block diagram of a PDP 100, according to an exemplary embodiment of the present disclosure. Referring to FIG. 5, the PDP 100 includes a substrate 110, a controller 120, a sustain driving unit 130, a scan driving unit 140, a first address driving unit 150, and a second address driving unit 160.

The substrate 110 includes sustain electrodes, scan electrodes, and address electrodes to display data, according to a voltage applied to the substrate 110. Since the PDP 100 is similar to the PDP shown in FIG. 2, a detailed explanation thereof will not be given.

The controller 120 receives an external analog image signal, converts the external analog image signal into a digital signal, and generates internal image signals, such as 8-bit RGB image data, a clock signal, and vertical and horizontal sync signals. Also, the controller 120 generates driving control signals SA-1, SA-2, SX, and SY, by which the driving units 150, 160, 130, and 140 are respectively controlled, according to the internal image signals.

The sustain driving unit 130 is connected to the sustain electrodes of the substrate 110, processes the sustain driving control signal SX, and applies a sustain pulse to the sustain electrodes. Since the sustain driving unit 130 applies the same sustain pulse to a first sustain electrode group and to a second sustain electrode group, the number of channels, through which the sustain pulse is output from the sustain driving unit 130, may be 1.

The scan driving unit 140 is connected to the scan electrodes of the substrate 110, processes the scan driving control signal SY, and applies a scan pulse to the scan electrodes. The scan driving unit 140 applies the same scan pulse to a scan electrode pair composed of one electrode included in a first scan electrode group and one electrode included in a second scan electrode group. Accordingly, the number of channels Z1*m* through Z960 through which the scan pulse is output from the scan driving unit 140, is 960, when the number of pixels is 1920×1080. However, it is obvious that the number of channels may vary, according to the particular number of pixels.

The first address driving unit 150 and the second address driving unit 160 process the address driving control signals SA-1 and SA-2, to generate a display data signal and apply the display data signal to the address electrodes. The PDP 100 may display data through a dual address method.

As described above, the PDP 100 may reduce the length of the sustain electrodes and the scan electrodes, by changing the direction in which the sustain electrodes and the scan electrodes extend, thereby making it possible to reduce the resistance of the sustain electrodes and the scan electrodes. Table 1 shows the bus resistance and the number of channels used to drive an integrated circuit (IC), in each of a general PDP and the PDP 100.

TABLE 1

| | General PDP | PDP of FIG. 5 | Ratio |
|---|---|---|---|
| Bus resistance | 100 Ω | 56 Ω | 56.3% |
| Number of channels of scan IC | 1080 | 960 (1920/2) | 88.9% |
| Number of channels of data IC | 5760 (1920 × 3) | 6480 (1080 × 2 × 3) | 112.5% |

As shown in Table 1, the resistance may be reduced by about 44%, by changing the direction in which the sustain electrodes and scan electrodes are arranged. FIGS. 3A through 4B shown that the magnitude of an applied voltage may be reduced, by reducing the resistance of electrodes.

Also, when the direction, in which the sustain electrodes and the scan electrodes are arranged, is changed, the number of channels of a scan IC included in the scan driving unit 140 was reduced by about 11%, and the number of channels of a data IC included in the first address driving unit 150 and the second address driving unit 160 was increased by about 12.5%. That is, although the direction, in which the sustain electrodes and the scan electrodes are arranged, is changed, the number of ICs and/or the number of channels of the ICs is almost the same as when the direction is not changed, thereby preventing manufacturing costs from increasing significantly.

As described above, a PDP according to the one or more exemplary embodiments of the present disclosure, may operate with reduced voltage levels.

It should be understood that the exemplary embodiments described therein should be considered in a descriptive sense only and not for purposes of limitation. Descriptions of features or aspects within each exemplary embodiment should typically be considered as available for other similar features or aspects in other embodiments.

Although a few exemplary embodiments of the present disclosure have been shown and described, it would be appreciated by those skilled in the art that changes may be made in these exemplary embodiments, without departing from the principles and spirit of the disclosure, the scope of which is defined in the claims and their equivalents.

What is claimed is:

1. A plasma display panel (PDP) comprising:

scan electrodes extending parallel to one another, in a first direction;

sustain electrodes extending parallel to the scan electrodes; and address electrodes extending across the scan electrodes and the sustain electrodes, in a second direction that is generally perpendicular to the first direction, wherein, at least two scan electrodes are adjacent between two corresponding ones of the sustain electrodes, the address electrodes are divided into a first address electrode group that includes ones of the address electrodes that extend from a first side of the PDP, and a second address electrode group that includes ones of the address electrodes that extend from an opposing second side of the PDP, the address electrodes of the first address electrode group do not extend between the address electrodes of the second address electrode group, and at least one of the scan electrodes crossing the first address electrode group is electrically connected to at least one of the scan electrodes crossing the second address electrode group, such that all of the scan electrodes that concurrently receive respective scan pulses receive a same pulse during an address period.

2. The PDP of claim 1, wherein:

the scan electrodes are divided into first and second scan electrode groups;

the sustain electrodes are divided into first and second sustain electrode groups;

the first address electrode group extends across the first scan electrode group and the first sustain electrode group; and the second address electrode group extends across the second scan electrode group and the second sustain electrode group.

3. The PDP of claim 2, further comprising:

a scan driving unit to apply the scan pulses to the first scan electrode group and the second scan electrode group;

a sustain driving unit to apply a sustain pulse to the first sustain electrode group and the second sustain electrode group;

a first address driving unit to apply an address pulse to the first address electrode group; and a second address driving unit to apply an address pulse to the second address electrode group.

4. The PDP of claim 3, wherein:

each of the scan electrodes of the first scan electrode group is connected to one of the scan electrodes of the second scan electrode group, so as to form scan electrode pairs; and the scan driving unit applies the same pulse to each scan electrode pair.

5. A method of manufacturing a plasma display panel (PDP), the method comprising:

forming parallel scan electrodes on a substrate, which extend in a first direction, from a first edge of the PDP;

forming parallel sustain electrodes on the substrate, which extend in the first direction, from an opposing second edge of the substrate; and forming address electrodes on the substrate, which extend across the scan electrodes and the sustain electrodes, in a second direction that is generally perpendicular to the first direction, wherein, at least two scan electrodes are adjacent between two corresponding ones of the sustain electrodes, the address electrodes are divided into a first address electrode group that extends from a third edge of the substrate, and a second address electrode group that extends from a fourth edge, such that the address electrodes of the first address electrode group do not extend between the address electrodes of the second address electrode group, at least one of the scan electrodes crossing the first address electrode group is electrically connected to at least one of the scan electrodes crossing the second address electrode group, thereby configuring the PDP such that all of the scan electrodes that concurrently receive respective scan pulses receive a same pulse during an address period.

6. The method of claim 5, wherein:

the scan electrodes are divided into a first scan electrode group and a second scan electrode group;

the sustain electrodes are divided into a first sustain electrode group and a second sustain electrode group;

the first address electrode group extends across the first scan electrode group and the first sustain electrode group; and the second address electrode group extends across the second scan electrode group and the second sustain electrode group.

7. The method of claim 6, further comprising:

a scan driving unit to apply the scan pulses to the first scan electrode group and the second scan electrode group;

a sustain driving unit to apply a sustain pulse to the first sustain electrode group and the second sustain electrode group;

a first address driving unit to apply an address pulse to the first address electrode group; and a second address driving unit to apply an address pulse to the second address electrode group.

8. The method of claim 7, wherein:

each of the scan electrodes of the first scan electrode group is connected to different one of the scan electrodes of the second scan electrode group, so as to form scan electrode pairs; and each scan electrode pair is connected to an output terminal of the scan driving unit.

* * * * *